US009436110B2

(12) United States Patent
Sugahara

(10) Patent No.: US 9,436,110 B2
(45) Date of Patent: Sep. 6, 2016

(54) ELECTROSTATIC LATENT IMAGE DEVELOPING TONER AND MANUFACTURING METHOD THEREFOR

(71) Applicant: KYOCERA Document Solutions Inc., Osaka (JP)

(72) Inventor: Masanori Sugahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/556,485

(22) Filed: Dec. 1, 2014

(65) Prior Publication Data

US 2015/0160576 A1 Jun. 11, 2015

(30) Foreign Application Priority Data

Dec. 9, 2013 (JP) ..... 2013-254232

(51) Int. Cl.
*G03G 9/093* (2006.01)

(52) U.S. Cl.
CPC ..... *G03G 9/09328* (2013.01); *G03G 9/09342* (2013.01); *G03G 9/09392* (2013.01)

(58) Field of Classification Search
CPC ..... G03G 9/09708; G03G 9/09716; G03G 9/09328; G03G 9/09342; G03G 9/09392
USPC ..... 430/110.2
See application file for complete search history.

(56) References Cited

U.S. PATENT DOCUMENTS

| | | | | |
|---|---|---|---|---|
| 4,740,443 | A * | 4/1988 | Nakahara | G03G 9/0825 430/108.24 |
| 5,215,854 | A * | 6/1993 | Yamazaki | G03G 9/0825 430/108.6 |
| 2003/0186151 | A1* | 10/2003 | Nakayama | G03G 9/08711 430/108.6 |
| 2003/0224274 | A1 | 12/2003 | Horikoshi et al. | |
| 2005/0271964 | A1 | 12/2005 | Etou et al. | |
| 2015/0072281 | A1* | 3/2015 | Okada | G03G 9/09392 430/105 |

FOREIGN PATENT DOCUMENTS

| | | | |
|---|---|---|---|
| JP | 2003-345056 | A | 12/2003 |
| JP | 2003-345058 | A | 12/2003 |
| JP | 2004-294468 | A | 10/2004 |
| JP | 2004-294469 | A | 10/2004 |
| JP | 2008150240 | A * | 7/2008 |
| JP | 2010-262111 | A | 11/2010 |

OTHER PUBLICATIONS

English language machine translation of JP 2008-150240 (Jul. 2008).*

* cited by examiner

*Primary Examiner* — Christopher Rodee
(74) *Attorney, Agent, or Firm* — Studebaker & Brackett PC

(57) ABSTRACT

An electrostatic latent image developing toner includes a plurality of toner particles each having a toner core, a shell layer, and needle-like particles. The needle-like particles adhere to a surface of the toner core. The shell layer contains a thermosetting resin and covers the needle-like particles and the toner core. The needle-like particles contain titanium oxide. The needle-like particles have a volume resistivity value of at least $1.0\times10^{1}$ Ω·cm and no greater than $1.0\times10^{8}$ Ω·cm. The needle-like particles have a number average major-axis diameter of at least 0.2 μm and no greater than 2.0 μm. The needle-like particles have a number average minor-axis diameter of at least 0.01 μm and no greater than 0.10 μm.

7 Claims, 1 Drawing Sheet

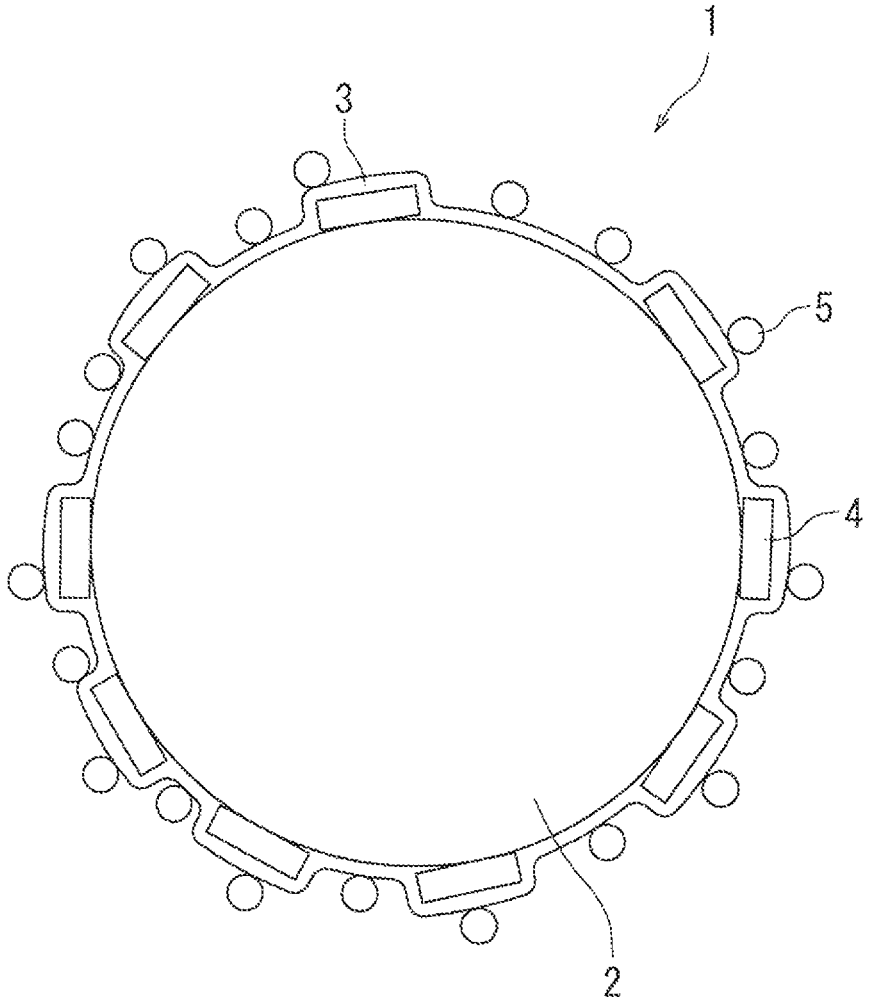
1
3
5
4
2

ELECTROSTATIC LATENT IMAGE DEVELOPING TONER AND MANUFACTURING METHOD THEREFOR

INCORPORATION BY REFERENCE

The present application claims priority under 32 U.S.C. §111 to Japanese Patent Application No. 2013-254232, filed Dec. 9, 2013. The contents of this application are incorporated herein by reference in their entirety.

BACKGROUND

The present disclosure relates to an electrostatic latent image developing toner and a manufacturing method for the toner.

For example, a core-shell structure toner that includes toner cores each having a surface covered with a urea resin has been suggested.

SUMMARY

An electrostatic latent image developing toner according to the present disclosure includes a plurality of toner particles each having a toner core, a shell layer, and needle-like particles. The needle-like particles adhere to a surface of the toner core. The shell layer contains a thermosetting resin and covers the needle-like particles and the toner core. The needle-like particles contain titanium oxide. The needle-like particles have a volume resistivity value of at least $1.0\times10^{1}$ Ω·cm and no greater than $1.0\times10^{8}$ Ω·cm. The needle-like particles have a number average major-axis diameter of at least 0.2 μm and no greater than 2.0 μm. The needle-like particles have a number average minor-axis diameter of at least 0.01 μm and no greater than 0.10 μm.

A manufacturing method for an electrostatic latent image developing toner according to the present disclosure involves: preparing toner cores; preparing needle-like particles; causing the needle-like particles to adhere to a surface of the toner cores; and forming shell layers on a surface of the respective toner cores each having the needle-like particles adhering thereto. The needle-like particles prepared contain titanium oxide. The needle-like particles prepared have a volume resistivity value of at least $1.0\times10^{1}$ Ω·cm and no greater than $1.0\times10^{8}$ Ω·cm. The needle-like particles prepared have a number average major-axis diameter of at least 0.2 μm and no greater than 2.0 μm. The needle-like particles prepared have a number average minor-axis diameter of at least 0.01 μm and no greater than 0.10 μm.

BRIEF DESCRIPTION OF THE DRAWINGS

FIGURE shows one of toner particles included in an electrostatic latent image developing toner according to an embodiment of the present disclosure.

DETAILED DESCRIPTION

The following provides detailed explanation of an embodiment of the present disclosure. However, the present disclosure is not limited to the embodiment below, and appropriate variations within the intended scope of the present disclosure can be made to practice the present disclosure. Also note that explanation is omitted where appropriate in order to avoid repetition, but such omission does not limit the substance of the present disclosure.

A toner according to the present embodiment is an electrostatic latent image developing toner. The toner according to the present embodiment is a powder that includes a plurality of toner particles (each of which has the following configuration). With reference to the FIGURE, the following explains the configuration of toner particles 1 included in the toner according to the present embodiment.

The toner according to the present embodiment includes the plurality of toner particles 1, one of which is shown in the FIGURE. Each of the toner particles 1 in the toner according to the present embodiment has a toner mother particle and an external additive 5. The toner mother particle has a toner core 2, a shell layer 3, and needle-like particles 4. The toner according to the present embodiment can be used in an electrophotographic copier, for example. Note that the external additive may be omitted if unnecessary. When the external additive is not included, the toner mother particles correspond to toner particles.

<<Toner Cores>>

The toner cores 2 contain a binder resin. The toner cores 2 may contain a colorant, a charge control agent, a releasing agent, and/or a magnetic powder. The following describes the components of the toner cores 2. Note that a generic term "(meth)acryl" may be used to refer to both acryl and methacryl.

[Binder Resin]

Examples of the binder resin contained in the toner cores 2 include thermoplastic resins, such as styrene-based resins, acrylic-based resins, styrene-acrylic-based resins, olefin-based resins (specifically, polyethylene resins and polypropylene resins), vinyl-based resins (specifically, vinyl chloride resins, polyvinyl alcohol resins, vinyl ether resins, and N-vinyl resins), polyester resins, polyamide resins, polyurethane resins, and styrene-butadiene-based resins. Among the resins listed above, a styrene acrylic-based resin or a polyester resin is preferable for ensuring good colorant dispersibility in the toner or good fixability of the toner to a recording medium. The following describes a styrene-acrylic-based resin and a polyester resin.

The styrene-acrylic-based resin is a copolymer of a styrene-based monomer and an acrylic-based monomer. Examples of the styrene-based monomer include styrene, α-methylstyrene, vinyltoluene, α-chlorostyrene, o-chlorostyrene, m-chlorostyrene, p-chlorostyrene, and p-ethylstyrene. Examples of the acrylic-based monomer include alkyl esters of (meth)acrylic acid, such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

A polyester resin that can be used as the binder resin is obtained through condensation polymerization or condensation copolymerization of a di-, tri-, or higher-hydric alcohol and a di-, tri-, or higher-basic carboxylic acid.

When the binder resin is a polyester resin, preferable examples of an alcohol that can be used in synthesis of the polyester resin include diols, bisphenols and tri-, or higher-hydric alcohols.

Preferable examples of diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, polyoxyethylenated bisphenol A, and polyoxypropylenated bisphenol A.

Preferable examples of tri-, or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

When the binder resin is a polyester resin, preferable examples of a carboxylic acid that can be used in synthesis of the polyester resin include di-, tri-, or higher basic carboxylic acids.

Preferable examples of dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specifically, n-butyl succinic acid, isobutylsuccinic acid, n-octylsuccinic acid, n-dodecylsuccinic acid, and isododecylsuccinic acid), and alkenyl succinic acids (specifically, n-butenyl succinic acid, isobutenylsuccinic acid, n-octenylsuccinic acid, n-dodecenylsuccinic acid, and isododecenylsuccinic acid).

Preferable examples of tri- or higher-basic carboxylic acids include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and EMPOL trimer acid.

The dibasic carboxylic acid or tri- or higher basic carboxylic acid to be used may be modified to an ester-forming derivative such as an acid halide, an acid anhydride, or a lower alkyl ester. Herein, the term "lower alkyl" refers to an alkyl group having one to six carbon atoms.

The softening point (Tm) of the binder resin is preferably at least 60° C. and no greater than 100° C., and more preferably at least 70° C. and no greater than 95° C.

The glass transition point (Tg) of the binder resin is preferably at least 50° C. and no greater than 65° C., and more preferably at least 50° C. and no greater than 60° C.

[Releasing Agent]

The toner cores 2 may contain a releasing agent if necessary. The releasing agent is used for example to improve the low-temperature fixability and the offset resistance of the toner.

Preferable examples of the releasing agent include: aliphatic hydrocarbon-based waxes, such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon-based waxes, such as polyethylene oxide wax and block copolymer of polyethylene oxide wax; plant waxes, such as candelilla wax, carnauba wax, Japan wax, jojoba wax, and rice wax; animal waxes, such as beeswax, lanolin, and spermaceti; mineral waxes, such as ozocerite, ceresin, and petrolatum; waxes having a fatty acid ester as major component, such as montanic acid ester wax and castor wax; and waxes such as deoxidized carnauba wax in which a part or all of a fatty acid ester has been deoxidized.

The amount of releasing agent is preferably at least 1 part by mass and no greater than 30 parts by mass relative to 100 parts by mass of the binder resin, and more preferably at least 5 parts by mass and no greater than 20 parts by mass.

[Colorant]

The toner cores 2 may contain a colorant if necessary. A commonly known pigment or dye may be used as the colorant contained in the toner cores 2 in accordance with the toner color. The following describes specific examples of a suitable colorant that can be contained in the toner cores 2.

Carbon black can for example be used as the black colorant. A colorant which is adjusted to a black color using colorants described below, such as a yellow colorant, a magenta colorant, and a cyan colorant, can be used as the black colorant.

When the toner is a color toner, the colorant contained in the toner cores 2 can for example be a yellow colorant, a magenta colorant, or a cyan colorant.

As the yellow colorant, for example, a condensed azo compound, an isoindolinone compound, an anthraquinone compound, an azo metal complex, a methine compound, or an arylamide compound is preferable. Preferable examples of the yellow colorant include C.I. pigment yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), naphthol yellow S, Hansa yellow G, and C.I. vat yellow.

As the magenta colorant, for example, a condensed azo compound, a diketopyrrolopyrrole compound, an anthraquinone compound, a quinacridone compound, a basic dye lake compound, a naphthol compound, a benzimidazolone compound, a thioindigo compound, or a perylene compound is preferable. Preferable examples of the magenta colorant include C.I. pigment red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

As the cyan colorant, for example, a copper phthalocyanine compound, a copper phthalocyanine derivative, an anthraquinone compound, or a basic dye lake compound is preferable. Preferable examples of the cyan colorant include C.I. pigment blue (1, 7, 15, 15:1, 15:2, 15:3, 15:4, 60, 62, and 66), phthalocyanine blue, C.I. vat blue, and C.I. acid blue.

The amount of the colorant is preferably at least 1 part by mass and no greater than 20 parts by mass relative to 100 parts by mass of the toner cores 2, and more preferably at least 3 parts by mass and no greater than 10 parts by mass.

[Charge Control Agent]

The toner cores 2 may contain a charge control agent if necessary. The charge control agent is used, for example, to improve the charge stability or the charge rise characteristic of the toner. The presence of a negatively chargeable charge control agent in the toner cores 2 can increase the anionic strength of the toner. The charge rise characteristics serves as an index indicating whether or not the toner can be charged to a predetermined charge level within a short period of time.

[Magnetic Powder]

The toner cores 2 may contain a magnetic powder if necessary. Preferable examples of the magnetic powder include iron (specifically ferrite and magnetite), ferromagnetic metals (specifically cobalt and nickel), alloys of either or both of iron and a ferromagnetic metal, ferromagnetic alloys subjected to ferromagnetization (for example, heat treatment), and chromium dioxide.

The magnetic powder preferably has a particle diameter of at least 0.1 μm and no greater than 1.0 μm, and more preferably at least 0.1 μm and no greater than 0.5 μm, in order that the magnetic powder can be uniformly dispersed throughout the binder resin.

When the toner is used as a one-component developer, the amount of the magnetic powder in the toner is preferably at least 35 parts by mass and no greater than 60 parts by mass relative to 100 parts by mass of the toner, and more preferably at least 40 parts by mass and no greater than 60 parts by mass.

<<Shell Layers>>

The shell layers 3 contain a thermosetting resin. The presence of a thermosetting resin in the shell layers 3 can increase the strength of the shell layers 3. The increased strength of the shell layers 3 can restrict rupturing of the shell layers 3 and consequent exposure of the needle-like particles 4 on the surface of the shell layers 3 during storage of the toner. The increased strength of the shell layers 3 can also reduce or prevent contamination of the development sleeve during image formation and improve the high-temperature preservability of the toner.

For a positively chargeable toner, it is preferable that the shell layers 3 are sufficiently cationic. In order to increase the cationic strength of the shell layers 3, a resin that forms the shell layers 3 preferably contain nitrogen atoms. A nitrogen-containing material is readily charged to a positive charge. The content of the nitrogen atoms in the shell layers 3 is preferably at least 10% by mass. As a resin containing nitrogen atoms, a resin containing an amino group (—$NH_2$) is preferable. Preferable examples of thermosetting resins containing an amino group include urea resins, sulfonamide resins, glyoxal resins, guanamine resins, aniline resins, polyimide resins, and derivatives of any of the aforementioned resins. A polyimide resin contains nitrogen atoms within the molecular framework thereof. Therefore, when the shell layers 3 contain a polyimide resin, the shell layers 3 tend to be strongly cationic. Preferable examples of polyimide resins forming the shell layers 3 include maleimide-based polymers and bismaleimide-based polymers (for example, amino-bismaleimide polymers and bismaleimide triazine polymers). The thermosetting resins listed above may be used singly or in a combination of two or more.

The thermosetting resin contained in the shell layers 3 can be synthesized using a monomer (shell material) such as melamine, methylol melamine, urea, benzoguanamine, acetoguanamine, or spiroguanamine.

The thermosetting resin contained in the shell layers 3 preferably has a methylene group (—$CH_2$—) derived from formaldehyde, for example. A melamine resin is a polycondensate of melamine and formaldehyde. A urea resin is a polycondensate of urea and formaldehyde. A glyoxal resin is a polycondensate of formaldehyde and a reaction product of glyoxal and urea. When the shell layers 3 contain a thermosetting resin and a thermoplastic resin, a monomer for forming the thermosetting resin may be methylolated with formaldehyde before reaction with a monomer for forming the thermoplastic resin.

When the shell layers 3 contain a thermosetting resin and a thermoplastic resin, the thermoplastic resin contained in the shell layers 3 preferably has a functional group that is reactive with a functional group (for example, a methylol group or an amino group) of the monomer of the thermosetting resin contained in the shell layers 3. Specifically, for example, the functional group that is reactive with a functional group of the thermosetting resin may be a functional group containing an active hydrogen atom (specifically, a hydroxyl group, a carboxyl group, or an amino group). The amino group may be part of a functional group such as a carbamoyl group (—$CONH_2$). In view of the ease of formation of the shell layers 3, the thermoplastic resin is preferably a resin containing (meth)acrylamide or a resin containing a monomer having a functional group such as a carbodiimide group, an oxazoline group, or a glycidyl group.

The shell layers 3 preferably have a thickness of at least 1 nm and no greater than 20 nm, and more preferably have a thickness of at least 1 nm and no greater than 10 nm. With the thickness of 20 nm or less (more preferably 10 nm or less), the shell layers 3 can be readily ruptured in response to heat and pressure applied for fixing the toner to a recording medium, which can restrict an excessive increase of the charge amount of the toner during image formation. With the thickness of 1 nm or more, the shell layers 3 can be less prone to rupture due to an impact during transportation of the toner, which can restrict an excessive decrease of the charge amount of the toner during image formation.

The thickness of the shell layers 3 can be measured by analyzing transmission electron microscopy (TEM) images of cross-sections of the toner particles 1 using commercially available image analysis software (for example, WinROOF, product of Mitani Corporation).

[Charge Control Agent]

The shell layers 3 may contain a charge control agent. The presence of a positively chargeable charge control agent in the shell layers 3 can increase the cationic strength of the shell layers 3.

<<Needle-Like Particles>>

The needle-like particles 4 each have a needle-like outer shape and reside between the toner core 2 and the shell layer 3. Each needle-like particle 4 adheres to the toner core 2 so as to be longitudinally parallel to a surface of the toner core 2. When a needle-like particle 4 adhering to the toner core 2 is longitudinally parallel to the surface of the toner core 2, the contact area between the surface of the toner core 2 and the needle-like particle 4 can be larger than a contact area between a spherical particle and the surface of the toner core 2. With the larger contact area, the needle-like particle 4 can be firmly fixed to the surface of the toner core 2.

With the needle-like particles 4 firmly fixed to the surface of the toner core 2, detachment of the needle-like particles 4 from the shell layer 3 as well as breakage of the needle-like particles 4 is restricted, which is effective to maintain an appropriate chargeability of the toner.

The needle-like particles 4 each contain titanium oxide. As the titanium oxide contained in the needle-like particle 4, anatase titanium oxide or rutile titanium oxide can be preferably used, for example. To reduce the volume resistivity value, which will be described later, of the needle-like particles 4 (to $1.0\times10^8$ Ω·cm or less, for example), anatase titanium oxide is particularly preferable as the titanium oxide contained in the needle-like particle 4.

To reduce the later-described volume resistivity value of the needle-like particles 4 (to $1.0\times10^8$ Ω·cm or less, for example), each needle-like particle 4 preferably includes a titanium oxide particle and a conductive layer residing on the surface of the titanium oxide particle. The conductive layer on the surface of the titanium oxide particle may be formed from tin oxide ($SnO_2$) doped with antimony (Sb). The presence of such a conductive layer can reduce the later-described volume resistivity value of the needle-like particle 4.

When the thermosetting resin contained in the shell layers 3 has a methylol group (—$CH_2OH$), in order to strengthen the bond between the shell layers 3 and the needle-like particles 4, the needle-like particles 4 are preferably titanium oxide particles each having a needle-like shape. Upon contact of a titanium oxide particle with water, hydroxyl groups are assumed to be formed on the surface of the titanium oxide particle. When the needle-like particles 4 are needle-like titanium oxide particles, the hydroxyl groups of the needle-like particles 4 are assumed to readily bonded to the methylol groups of the shell layer 3 through a dehydration condensation reaction. The strong bond between the shell layer 3 and the needle-like particles 4 can consequently provide a strong bond between the toner core 2 and the shell layer 3 via the needle-like particles 4. When the toner cores 2 contain a polyester resin, the methylol groups of the shell layer 3 are readily bonded to the carboxyl groups of the polyester resin through an esterification reaction.

The strong bond between the shell layer 3 and the needle-like particles 12 can similarly be facilitated through a surface hydrophilic treatment of the needle-like particles 4. Examples of a hydrophilic treatment agent usable for the surface hydrophilic treatment of the needle-like particles 4 include a silicon (Si)-based treatment agent, an aluminum (Al)-based treatment agent, an organic treatment agent, and sodium alginate.

In view of the uniform surface chargeability of the individual toner particles 1, it is preferable that the needle-like particles 4 are uniformly disposed on the surface of each toner core 2. When a cationic shell layer 3 on the surface of a toner particle 1 is non-uniform in thickness, the surface charge distribution of the toner particle 1 tends to be broad, and thus the surface chargeability of the toner particle 1 tends to be non-uniform. When the needle-like particles 4 are uniformly disposed on the surface of a toner core 2, the shell layer 3 on the surface of the toner particle 1 tends to be uniform in thickness, which consequently facilitates the surface of the toner particle 1 to be uniformly charged. When the toner particles 1 each have an equal amount of needle-like particles 1, the charge distribution of the toner tends to be sharp.

To improve the low-temperature fixability and the chargeability of the toner, the amount of the needle-like particles 4 is preferably at least 0.1 parts by mass and no greater than 5.0 parts by mass relative to 100 parts by mass of the toner, and more preferably at least 0.1 parts by mass and no greater than 4.5 parts by mass. With the needle-like particles 4 contained in an amount of at least 0.1 parts by mass, the shell layers 3 can be readily ruptured and thus the minimum temperature for fixing the toner can be lowered. With the needle-like particles 4 contained in an amount of no greater than 5.0 parts by mass, an excessive increase of the charge amount of the toner can be restricted and formation of images with a density lower than a desired density value is restricted.

To improve the charge stability of the toner and the bonding strength between each toner core 2 and the needle-like particles 4, the needle-like particles 4 preferably have a number average major-axis diameter of at least 0.2 μm and no greater than 2.0 μm when measured by the following method or its alternative method. With the needle-like particles 4 having a number average major-axis diameter of at least 0.2 μm, the charge stability of the toner tends to improve. With the needle-like particles 4 having a number average major-axis diameter of no greater than 2.0 μm, it is easier to ensure that each needle-like particle 4 adhering to the toner core 2 is longitudinally parallel to the surface of the toner core 2.

To improve the handling property and the charge stability of the toner, the needle-like particles 4 preferably have a number average minor-axis diameter of at least 0.01 μm and no greater than 0.10 μm when measured by the following method or its alternative method. With the needle-like particles 4 having a number average minor-axis diameter of at least 0.01 μm, the mechanical strength of the needle-like particles 4 tends to increase, which consequently tends to improve the handling property of the toner. With the needle-like particles 4 having a number average minor-axis diameter of no greater than 0.10 μm, the charge stability of the toner tends to improve.

<Method for Measuring Number Average Major- and Minor-Axis Diameters of Needle-Like Particles>

A scanning electron microscope (JSM-7500F, product of JEOL Ltd.) is used to capture images of randomly selected 100 samples (needle-like particles) at a predetermined magnification (for example, 50,000 times). Subsequently, the captured images are analyzed by using image analysis software to measure the major- and minor-axis diameters of each of the 100 samples. Subsequently, the sum of all the major-axis diameters measured and the sum of all the minor-axis diameters majored are each divided by the number of samples measured (by 100). As a result, the number average major-axis diameter and the number average minor-axis diameter of the samples (needle-like particles) are calculated. In addition, the number average major-axis diameter is divided by the number average minor-axis diameter to calculate the aspect ratio (=Number Average Major-Axis Diameter/Number Average Minor-Axis Diameter) of the needle-like particles.

To improve the chargeability of the toner, the needle-like particles 4 preferably have the volume resistivity value of at least $1.0\times10^{1}$ Ω·cm and no greater than $1.0\times10^{8}$ Ω·cm when measured by the following method or its alternative method. With the needle-like particles 4 having a volume resistivity value of at least $1.0\times10^{1}$ Ω·cm, the charge stability of the toner is expected to improve, facilitating formation of images with an appropriate image density. With the needle-like particles 4 having a volume resistivity value of no greater than $1.0\times10^{8}$ Ω·cm, an excessive increase of the charge amount of the toner is expected to be restricted, which is assumed to improve the charge stability of the toner. The titanium oxide particles having anatase crystal structure typically have a volume resistivity value of $1.0\times10^{8}$ Ω·cm or less. On the other hand, the titanium oxide particles having rutile crystal structure typically have a volume resistivity value of at least $1.0\times10^{13}$ Ω·cm and no greater than $1.0\times10^{14}$ Ω·cm.

<Method for Measuring Volume Resistivity Value of Needle-Like Particles>

First, 5 g of samples (needle-like particles) is put into the measurement cell of an ohmmeter (R6561, product of ADVANTEST CORPORATION) and a load of 1 kg is imposed on the samples. Subsequently, a pair of electrodes is connected to the samples. Then, a DC voltage of 10 V is applied across the electrodes to measure electrical resistance of the samples. Then, the volume resistivity value of the samples (needle-like particles) is calculated based on the measured value of the electrical resistance and the dimensions of the samples at the time of the electrical resistance measurement. Note that the volume resistivity value is expressed by the following formula:

Volume Resistivity Value=Electrical Resistance Value×Cross Section of Current Path/Length of Current Path.

<<External Additive>>

To improve the fluidity and the handling property of the toner, the external additive may adhere to the surface of the shell layers 3.

Preferable examples of the external additive 5 include silica and metal oxides (specifically, alumina, titanium oxide, magnesium oxide, zinc oxide, strontium titanate, and barium titanate). The external additives listed above may be used alone or in combination of two or more.

To improve the fluidity and the handling property of the toner, the external additive 5 preferably has a particle diameter of at least 0.01 μm and no greater than 1.0 μm. The additive amount of the external additive 5 is preferably at least 1 part by mass and no greater than 10 parts by mass relative to 100 parts by mass of the toner cores 2, and more preferably at least 2 parts by mass and no greater than 5 parts by mass.

<<Method for Manufacturing Electrostatic Latent Image Developing Toner>>

A manufacturing method for an electrostatic latent image developing toner according to the present disclosure involves a first preparation process (preparation of the toner cores 2), a second preparation process (preparation of the needle-like particles 4), a first adhesion process (causing adhesion of the needle-like particles 4), a shell layer formation process, and a second adhesion process (causing adhesion of the external additive 5). In the first preparation process, the toner cores 2 are prepared. In the second preparation process, the needle-like particles 4 are prepared. In the first adhesion process, the needle-like particles 4 are caused to adhere to the surface of the toner cores 2. In the shell layer formation process, the shell layers 3 are formed on the surface of the toner cores 2 each having the needle-like particles 4 adhering thereto. In the second adhesion process, the external additive 5 is caused to adhere to the surface of the toner mother particles. Note that the second adhesion process may be omitted if unnecessary.

[First Preparation Process]

In the first preparation process, the toner cores 2 are produced, for example. The toner cores 2 may be produced by using a melt-kneading method or an aggregation method, for example.

The melt-kneading method involves a mixing process, a melt-kneading process, a pulverizing process, and a classifying process. In the mixing process, the binder resin and an internal additive (for example, a colorant and a releasing agent) are mixed to obtain a mixture. In the melt-kneading process, the resultant mixture is melt-kneaded to obtain a melt-knead. In the pulverization process, the resultant melt-knead is pulverized to obtain a pulverized product. In the classification process, the pulverized product is classified to obtain the toner cores 2 having desired particle diameters.

The aggregation method involves an aggregation process and a coalescence process. In the aggregation process, particulates having the components of the toner cores 2 are caused to aggregate in an aqueous medium. As a result, aggregated particles are obtained. In the coalescence process, the components contained in the aggregated particles obtained through the aggregation process are caused to coalesce in the aqueous medium. As a result, the toner cores 2 are obtained.

[Second Preparation Process]

In the second preparation process, the needle-like particles 4 are produced, for example. The following explains an example of a method of producing the needle-like particles 4. First, metatitanic acid is obtained through a known method, such as a sulfuric acid method. Subsequently, aqueous sodium hydroxide and titanium oxide ($TiO_2$) are added to the resultant metatitanic acid to obtain a solution. Subsequently, the resultant solution is heated. After the heating, the resultant solution is sufficiently washed with pure water. After the washing, the resultant solution is heated to the boiling point of hydrochloric acid. Subsequently, the solution is cooled. After the cooling, the pH of the resultant solution is adjusted to 7 though the addition of 1N-aqueous sodium hydroxide. After the pH adjustment, the resulting solution is neutralized, washed, and dried. Through the above, titanium oxide particles that are not yet sintered are obtained.

Subsequently, the resulting titanium oxide particles not yet sintered are mixed with sodium pyrophosphate decahydrate ($Na_2P_2O_7.10H_2O$) by using a vibratory ball mill to obtain a mixture. The resultant mixture is sintered by using an electric furnace. The resultant sinter is put into pure water to obtain a mixture and the mixture is then heated. After the heating, the resultant mixture is washed with pure water to remove soluble salt. Through the above, the needle-like particles 4 are obtained.

The number average major- and minor-axis diameters of the needle-like particles 4 can be adjusted by changing at least either the sintering temperature or time of the titanium oxide particles. For example, a higher sintering temperature results in a larger number average major- and minor-axis diameters of the titanium oxide particles each included in a needle-like particle 4 (and thus equivalently of the needle-like particles 4). A lower sintering temperature results a smaller number average major- and minor-axis diameters of the titanium oxide particles each included in a needle-like particle 4 (and thus equivalently of the needle-like particles 4).

The volume resistivity value of the needle-like particles 4 can be adjusted by providing each needle-like particle 4 with a conductive layer. For example, the presence of a conductive layer formed from tin oxide ($SnO_2$) doped with antimony (Sb) on the surface of each titanium oxide particle can reduce the volume resistivity value of the needle-like particles 4 as compared with the volume resistivity value of the titanium oxide particles.

[First Adhesion Process]

In the first adhesion process, the needle-like particles 4 are caused to adhere to the surface of the toner cores 2 obtained through the first preparation process such that each needle-like particle 4 is longitudinally parallel to the surface of the toner core 2. The needle-like particles 4 may be caused to adhere to the surface of the toner cores 2 by a method of mixing the toner cores 2 with the needle-like particles 4 by using a mixer, such as FM mixer (product of Nippon Coke & Engineering Co., Ltd.) or Nauta mixer (registered Japanese trademark, product of Hosokawa Micron Corporation), under the conditions ensuring that the needle-like particles 4 are not embedded in the toner cores 2.

[Shell Layer Formation Process]

The shell layer formation process involves a supply process and a resinification process. In the supply process, a shell material (for example, a solution containing a monomer for forming a thermosetting resin) is supplied to the surface of the toner cores 2 each having the needle-like particles 4 adhering thereto. In the resinification process, the shell material supplied to the surface of the toner cores 2 is resinified.

Specific example of a method of supplying the shell material to the surface of the toner cores 2 include a method of spraying a solution containing the shell material onto the surface of the toner cores 2 and a method of soaking the toner cores 2 in a solution containing the shell material.

The solvent used to prepare the solution containing the shell material is toluene, acetone, methyl ethyl ketone, tetrahydrofuran, or water, for example.

To improve the dispersibility of the toner cores 2, a dispersant may be added to the solution containing the shell material. Preferably, the dispersant is contained in an amount small enough to be removed by washing in a subsequent process and yet sufficient for improving the dispersibility of the toner cores 2. Specifically, a preferable amount of the dispersant is at least 0.1 parts by mass and no greater than 15 parts by mass relative to 100 parts by mass of the solution containing the shell material.

In the resinification process, the shell material (monomer or prepolymer) is resinified through polymerization or condensation. Through the above, the shell layers 3 are formed on the surface of the respective toner cores 2 each having the needle-like particles 4 adhering thereto.

For the shell layers 3 to have an appropriate degree of hardness (such that the shell layers 3 are not ruptured during storage of the toner but easily ruptured at the time of fixing the toner), the temperature of the solution at the time of the resinifying reaction is at least 40° C. and no greater than 90° C., and more preferably at least 50° C. and no greater than 80° C.

Through the shell layer formation process, toner mother particles are obtained. Subsequently to the shell layer formation process, a washing process, a drying process, and a second adhesion process (external addition process) are conducted as necessary to obtain an electrostatic latent image developing toner according to the present embodiment.

In the washing process, the toner mother particles are washed with pure water, for example.

In the drying process, the washed toner mother particles are dried by using, for example, a drying apparatus (a spray dryer, a fluid bed dryer, a vacuum freeze dryer, or a reduced pressure dryer). In order to restrict aggregation of the toner mother particles during drying, the use of a spray dryer is particularly preferable. Since the method using a spray dryer involves atomizing a dispersion containing the external additive 5 (for example, silica particles), it is possible to conduct the drying process and the external addition process, which will be described later, at the same time.

[Second Preparation Process]

The external additive 5 is caused to adhere to the surface of the shell layers 3. As a result, the toner particles 1 are produced. The external additive 5 may be caused to adhere by a method of mixing the toner mother particles with the external additive 5 by using a mixer, such as FM mixer (product of Nippon Coke & Engineering Co., Ltd.) or Nauta mixer (registered Japanese trademark, product of Hosokawa Micron Corporation), under the conditions ensuring that the particles of the external additive 5 are not embedded in the shell layers 3.

EXAMPLES

The following describes Examples of the present disclosure. However, the present disclosure is not limited to the Examples below.

Table 1 shows toners (each being an electrostatic latent image developing toner) of Examples 1-8 and Comparative Examples 1-7.

TABLE 1

| | Titanium Oxide Particles | Major-Axis Diameter [μm] | Minor-Axis Diameter [μm] | Aspect Ratio [—] | Volume Resistivity Value [Ω · cm] | Shell Layer |
|---|---|---|---|---|---|---|
| Example 1 | A (Needle-Like) | 1.68 | 0.070 | 24.0 | $3.0 \times 10^5$ | Melamine |
| Example 2 | B (Needle-Like) | 1.68 | 0.070 | 24.0 | $1.0 \times 10^1$ | Melamine |
| Example 3 | C (Needle-Like) | 1.68 | 0.070 | 24.0 | $1.0 \times 10^6$ | Melamine |
| Example 4 | D (Needle-Like) | 0.25 | 0.050 | 5.0 | $2.0 \times 10^5$ | Melamine |
| Example 5 | E (Needle-Like) | 1.80 | 0.050 | 36.0 | $1.0 \times 10^8$ | Melamine |
| Example 6 | F (Needle-Like) | 1.00 | 0.080 | 12.5 | $2.0 \times 10^5$ | Melamine |
| Example 7 | G (Needle-Like) | 1.00 | 0.020 | 50.0 | $7.0 \times 10^4$ | Melamine |
| Example 8 | A (Needle-Like) | 1.68 | 0.070 | 24.0 | $3.0 \times 10^5$ | Urea |
| Comparative Example 1 | H (Needle-Like) | 1.68 | 0.070 | 24.0 | $1.0 \times 10^9$ | Melamine |
| Comparative Example 2 | I (Needle-Like) | 1.68 | 0.070 | 24.0 | $1.0 \times 10^{-1}$ | Melamine |
| Comparative Example 3 | J (Needle-Like) | 0.12 | 0.050 | 2.40 | $2.0 \times 10^5$ | Melamine |
| Comparative Example 4 | K (Needle-Like) | 2.50 | 0.050 | 50.0 | $2.0 \times 10^5$ | Melamine |
| Comparative Example 5 | L (Needle-Like) | 1.00 | 0.007 | 142.0 | $1.0 \times 10^6$ | Melamine |
| Comparative Example 6 | M (Needle-Like) | 1.00 | 0.140 | 7.1 | $1.0 \times 10^6$ | Melamine |
| Comparative Example 7 | N (Spherical) | 0.200 | | — | $1.0 \times 10^1$ | Melamine |

Example 1

Preparation of Toner Cores

First, an FM mixer (FM-10, product of Nippon Coke & Engineering Co., Ltd.) was used to stir to mix 91 parts by mass of a polyester resin (HP-313, product of Nippon Synthetic Chemical Industry Co., Ltd.), 3 parts by mass of a colorant (MA-100, carbon black, product of Mitsubishi Chemical Corporation), and 6 parts by mass of a releasing agent (WEP-4, WAX, product of NOF CORPORATION) to obtain a mixture. Subsequently, the resultant mixture was melt-kneaded by using a twin screw extruder (TEM-26SS, product of TOSHIBA MACHINE CO., LTD.) to obtain a melt-knead.

Subsequently, the resultant melt-knead was coarsely pulverized by using a pulverizer (Rotoplex (registered Japanese trademark), product of Hosokawa Micron Corporation) to obtain coarse particles having a volume median diameter ($D_{50}$) of 2.0 mm. The resultant coarse particles are further pulverized by using a mechanical pulverizer (Turbo Mill (RS type), product of FREUND-TURBO CORPORATION) to obtain a pulverized product. Subsequently, the resultant pulverized product was classified using an air classifier (E-J-L-3 (LABO), product of Nittetsu Mining Co., Ltd.). Through the above, the toner cores having a volume median diameter ($D_{50}$) of 7.0 μm was obtained.

[Preparation of Needle-Like Particles]

The toner of Example 1 was manufactured using the needle-like particles A. Each of the needle-like particles A included an anatase titanium oxide particle produced by the method described above and a conductive layer of tin oxide ($SnO_2$) doped with antimony (Sb). The needle-like particles A had the number average major- and minor-axis diameters adjusted to the values shown in Table 1 by changing at least either the sintering temperature or time of the titanium oxide particles. In addition, the needle-like particles A had the volume resistivity value adjusted to the value shown in Table 1 by providing the conductive layers on the surface of the respective titanium oxide particles. In addition, the needle-like particles A were subjected to a hydrophilic surface treatment using a Si-based treatment agent.

[Adhesion of Needle-Like Particles]

FM mixer (FM-10, Nippon Coke & Engineering Co., Ltd.) was used to mix 100 parts by mass of the toner cores and 2 parts by mass of the needle-like particles A at a rotation speed of 5,000 rpm for 5 minutes. This caused the needle-like particles A to adhere to the surface of the toner cores.

[Shell Layer Formation Process]

A three-necked flask having 1 L capacity was set up in a water bath (IWB-250, product of AS ONE Corporation) maintained at 30° C., and 300 mL of ion exchanged water was added to the flask. Subsequently, hydrochloric acid was added to the contents of the flask to adjust the pH to 4.

Subsequently, 2 mL of methylolmelamine (Nikaresin (registered Japanese trademark) S-260, product of Nippon Carbide Industries Co., Inc.) was added to the flask to dissolve tmethylolmelamine within the flask. As a result, a solution of a shell material was obtained.

Subsequently, 300 g of the toner cores each having the needle-like particles A adhering thereto was added to the resultant solution of the shell material, followed by sufficient stirring. Then, 500 mL of ion exchanged water was added to the flask. While the contents of the flask were stirred, the temperature of the contents of the flask was raised up to 70° C. Thereafter, the contents of the flask maintained at 70° C. were stirred for two hours. Subsequently, aqueous sodium hydroxide was added to the flask to neutralize the contents of the flask to pH 7. As a result, a dispersion containing toner mother particles each having a shell layer covering the surface of the toner core was obtained.

Subsequently, by using a Buchner funnel, a wet cake of the toner mother particles was filtered out from the toner mother particle-containing dispersion. The toner mother particles were then washed by dispersing the wet cake of the toner mother particles in ion exchanged water. The same set of processes with ion exchanged water was repeated several times to wash the toner mother particles. After the washing, the wet cake of the toner mother particles was dried to obtain the dried toner mother particles.

[External Addition Process]

Then, FM mixer (FM-10, product of Nippon Coke & Engineering Co., Ltd.) was used to mix 100 parts by mass of the toner mother particles, 1.5 parts by mass of silica particulates (CAB-O-SIL TG-308F, product of Cabot Japan K.K.), and 1.0 parts by mass of titanium oxide (MT-500B, product of TAYCA CORPORATION) at a rotation speed of 3,500 rpm for 5 minutes. Through the above, the toner of Example 1 was obtained.

Example 2

The toner of Example 2 was obtained through the same processes as Example 1 except that needle-like particles B were used instead of the needle-like particles A. The needle-like particles B each included an anatase titanium oxide particle produced by the method described above and a conductive layer of tin oxide ($SnO_2$) doped with antimony (Sb). The needle-like particles B had the number average major- and minor-axis diameters adjusted to the values shown in Table 1 by changing at least either the sintering temperature or time of the titanium oxide particles. In addition, the needle-like particles B had the volume resistivity value adjusted to the value shown in Table 1 by providing the conductive layers on the surface of the respective titanium oxide particles. In addition, the needle-like particles B were subjected to a hydrophilic surface treatment using a Si-based treatment agent.

Example 3

The toner of Example 3 was obtained through the same processes as Example 1 except that needle-like particles C were used instead of the needle-like particles A. The needle-like particles C each included an anatase titanium oxide particle produced by the method described above and a conductive layer of tin oxide ($SnO_2$) doped with antimony (Sb). The needle-like particles C had the number average major- and minor-axis diameters adjusted to the values shown in Table 1 by changing at least either the sintering temperature or time of the titanium oxide particles. In addition, the needle-like particles C had the volume resistivity value adjusted to the value shown in Table 1 by providing the conductive layers on the surface of the respective titanium oxide particles. In addition, the needle-like particles C were subjected to a hydrophilic surface treatment using a Si-based treatment agent.

Example 4

The toner of Example 4 was obtained through the same processes as Example 1 except that needle-like particles D were used instead of the needle-like particles A. The needle-like particles D each included an anatase titanium oxide particle produced by the method described above and a conductive layer of tin oxide ($SnO_2$) doped with antimony (Sb). The needle-like particles D had the number average major- and minor-axis diameters adjusted to the values shown in Table 1 by changing at least either the sintering temperature or time of the titanium oxide particles. In addition, the needle-like particles D had the volume resistivity value adjusted to the value shown in Table 1 by providing the conductive layers on the surface of the respective titanium oxide particles. In addition, the needle-like particles D were subjected to a hydrophilic surface treatment using a Si-based treatment agent.

Example 5

The toner of Example 5 was obtained through the same processes as Example 1 except that needle-like particles E were used instead of the needle-like particles A. The needle-like particles E each included an anatase titanium oxide particle produced by the method described above and a conductive layer of tin oxide ($SnO_2$) doped with antimony (Sb). The needle-like particles E had the number average major- and minor-axis diameters adjusted to the values shown in Table 1 by changing at least either the sintering temperature or time of the titanium oxide particles. In addition, the needle-like particles E had the volume resistivity value adjusted to the value shown in Table 1 by providing the conductive layers on the surface of the respective titanium oxide particles. In addition, the needle-like particles E were subjected to a hydrophilic surface treatment using a Si-based treatment agent.

Example 6

The toner of Example 6 was obtained through the same processes as Example 1 except that needle-like particles F were used instead of the needle-like particles A. The needle-like particles F each included an anatase titanium oxide particle produced by the method described above and a conductive layer of tin oxide ($SnO_2$) doped with antimony (Sb). The needle-like particles F had the number average major- and minor-axis diameters adjusted to the values shown in Table 1 by changing at least either the sintering temperature or time of the titanium oxide particles. In addition, the needle-like particles F had the volume resistivity value adjusted to the value shown in Table 1 by providing the conductive layers on the surface of the titanium oxide particles. In addition, the needle-like particles F were subjected to a hydrophilic surface treatment using a Si-based treatment agent.

Example 7

The toner of Example 7 was obtained through the same processes as Example 1 except that needle-like particles G were used instead of the needle-like particles A. The needle-like particles G each included an anatase titanium oxide particle produced by the method described above and a conductive layer of tin oxide ($SnO_2$) doped with antimony (Sb). The needle-like particles G had the number average major- and minor-axis diameters adjusted to the values shown in Table 1 by changing at least either the sintering temperature or time of the titanium oxide particles. In addition, the needle-like particles G had the volume resistivity value adjusted to the value shown in Table 1 by providing the conductive layers on the surface of the respective titanium oxide particles. In addition, the needle-like particles G were subjected to a hydrophilic surface treatment using a Si-based treatment agent.

Example 8

The toner of Example 8 was obtained through the same processes as Example 1 except that an aqueous solution of a methylated urea resin (NIKALAC (registered Japanese trademark) MX-280, product of SANWA Chemical Co., Ltd) was used instead of methylolmelamine.

Comparative Example 1

The toner of Comparative Example 1 was obtained through the same processes as Example 1 except that needle-like particles H were used instead of the needle-like particles A. As the needle-like particles H, anatase titanium oxide particles produced by the method described above were used. The needle-like particles H had the number average major- and minor-axis diameters adjusted to the values shown in Table 1 by changing at least either the sintering temperature or time of the titanium oxide particles.

Comparative Example 2

The toner of Comparative Example 2 was obtained through the same processes as Example 1 except that needle-like particles I were used instead of the needle-like particles A. The needle-like particles I each included an anatase titanium oxide particle produced by the method described above and a conductive layer of tin oxide ($SnO_2$) doped with antimony (Sb). The needle-like particles I had the number average major- and minor-axis diameters adjusted to the values shown in Table 1 by changing at least either the sintering temperature or time of the titanium oxide particles. In addition, the needle-like particles I had the volume resistivity value adjusted to the value shown in Table 1 by providing the conductive layers on the surface of the respective titanium oxide particles. In addition, the needle-like particles I were subjected to a hydrophilic surface treatment using a Si-based treatment agent.

Comparative Example 3

The toner of Comparative Example 3 was obtained through the same processes as Example 1 except that needle-like particles J were used instead of the needle-like particles A. The needle-like particles J each included an anatase titanium oxide particle produced by the method described above and a conductive layer of tin oxide ($SnO_2$) doped with antimony (Sb). The needle-like particles J had the number average major- and minor-axis diameters adjusted to the values shown in Table 1 by changing at least either the sintering temperature or time of the titanium oxide particles. In addition, the needle-like particles J had the volume resistivity value adjusted to the value shown in Table 1 by providing the conductive layers on the surface of the respective titanium oxide particles. In addition, the needle-like particles J were subjected to a hydrophilic surface treatment using a Si-based treatment agent.

Comparative Example 4

The toner of Comparative Example 4 was obtained through the same processes as Example 1 except that needle-like particles K were used instead of the needle-like particles A. The needle-like particles K each included an anatase titanium oxide particle produced by the method described above and a conductive layer of tin oxide ($SnO_2$) doped with antimony (Sb). The needle-like particles K had the number average major- and minor-axis diameters adjusted to the values shown in Table 1 by changing at least either the sintering temperature or time of the titanium oxide particles. In addition, the needle-like particles K had the volume resistivity value adjusted to the value shown in Table 1 by providing the conductive layers on the surface of the respective titanium oxide particles. In addition, the needle-like particles K were subjected to a hydrophilic surface treatment using a Si-based treatment agent.

Comparative Example 5

The toner of Comparative Example 5 was obtained through the same processes as Example 1 except that needle-like particles L were used instead of the needle-like particles A. The needle-like particles L each included an anatase titanium oxide particle produced by the method described above and a conductive layer of tin oxide ($SnO_2$) doped with antimony (Sb). The needle-like particles L had the number average major- and minor-axis diameters adjusted to the values shown in Table 1 by changing at least either the sintering temperature or time of the titanium oxide particles. In addition, the needle-like particles L had the volume resistivity value adjusted to the value shown in Table 1 by providing the conductive layers on the surface of the respective titanium oxide particles. In addition, the needle-like particles L were subjected to a hydrophilic surface treatment using a Si-based treatment agent.

Comparative Example 6

The toner of Comparative Example 6 was obtained through the same processes as Example 1 except that needle-like particles M were used instead of the needle-like particles A. The needle-like particles M each included an anatase titanium oxide particle produced by the method described above and a conductive layer of tin oxide ($SnO_2$) doped with antimony (Sb). The needle-like particles M had the number average major- and minor-axis diameters adjusted to the values shown in Table 1 by changing at least either the sintering temperature or time of the titanium oxide particles. In addition, the needle-like particles M had the volume resistivity value adjusted to the value shown in Table 1 by providing the conductive layers on the surface of the respective titanium oxide particles. In addition, the needle-like particles M were subjected to a hydrophilic surface treatment using a Si-based treatment agent.

Comparative Example 7

The toner of Comparative Example 7 was obtained through the same processes as Example 1 except that spherical particles N were used instead of the needle-like particles A. The spherical particles N were titanium oxide particles (ET-600W, product of HARA SANGYO KAISHA, LTD.) each having a spherical outer shape.

[Evaluation Method]

The respective samples (Examples 1-8 and Comparative Examples 1-7) were evaluated by the following method. As to the needle-like particles, the toners of Examples 1-8 and Comparative Examples 1-6 were evaluated before the needle-like particles were caused to adhere to the surface of the toner cores. However, the needle-like particles once caused to adhere to the toner particles may be evaluated by detaching the needle-like particles from the toner particles. In addition, the spherical particles included in the toner of Comparative Example 7 were evaluated in a similar manner.

[Number Average Major- and Minor-Axis Diameters and Aspect Ratio of Needle-Like Particles]

A scanning electron microscope (JSM-7500F, product of JEOL Ltd.) was used to capture images of the randomly selected 100 needle-like particles of each sample (toner) at a magnification of 50,000 times. Subsequently, the captured images were analyzed by using image analysis software to measure the major- and minor-axis diameters of each of the 100 needle-like particles. Subsequently, the sum of all the major-axis diameters measured and the sum of all the minor-axis diameters majored were each divided by the number of needle-like particles measured (100). Through the calculation, the number average major- and minor-axis diameters of the needle-like particles were obtained. In addition, the number average major-axis diameter was divided by the number average minor-axis diameter to obtain the aspect ratio of the needle-like particles (=Number Average Major-Axis Diameter/Number Average Minor-Axis Diameter).

[Volume Resistivity Value of Needle-Like Particles]

First, 5 g of the needle-like particles of the sample (toner) was put into the measurement cell of an ohmmeter (R6561, product of ADVANTEST CORPORATION), and a load of 1 kg was imposed on the needle-like particles placed in the measurement cell. Subsequently, the electrodes of the ohmmeter were connected to the needle-like particles placed in the measurement cell and a DC voltage of 10 V was applied across the electrodes to measure the electrical resistance of the needle-like particles. Then, the volume resistivity value of the needle-like particles was calculated based on the measured value of the electrical resistance and the dimensions of the needle-like particles at the time of the electrical resistance measurement.

[Chargeability, Charge Distribution, and Fixability]

Each sample (toner) was used to produce a two-component developer, and the chargeability, the charge distribution, and the fixability of the sample (toner) were evaluated by evaluating the two-component developer thus prepared. The carrier used to prepare the developer was produced by the following method.

First, 2 kg of an epoxy resin (jER, product of Mitsubishi Chemical Corporation) was dissolved in 20 L of acetone to obtain a solution. Subsequently, 100 g of diethylenetriamine and 150 g of phthalic anhydride were added to the resultant solution to obtain a liquid mixture. Subsequently, the resultant liquid mixture and 10 kg of ferrite particles as carrier cores (F51-50, product of Powdertech Co., Ltd.) were put into a fluid bed coater (SFC-5, product of Freund Corporation). Subsequently, while hot wind of 80° C. was sent into the fluid bed coater, the fluid bed coater was operated to coat the surface of the ferrite particles with the epoxy resin. The resultant resin-coated particles were dried at 180° C. for 1 hour by using a dryer. As a result, the evaluation carrier was obtained.

(Charge Amount)

First, 0.8 g of the sample (toner) and 10 g of the evaluation carrier prepared through the processes described above were put into a plastic container having 20 mL capacity. Subsequently, the plastic container was rotated at a rotation speed of 100 rpm by using a rotating mechanism for a predetermined time period (1 minute or 60 minutes). Through the above, an evaluation developer (two-component developer) having stirred for 1 minute and an evaluation developer having stirred for 60 minutes were obtained. Each evaluation developer was measured for the charge amount (μC/g) by using a Q/m meter (210HS-2, product of TREK, Inc.). Specifically, the evaluation developer was put into the measurement cell of the Q/m meter, and the toner was drawn from the evaluation developer for 10 seconds through a stainless steel diagonal mesh having an opening of 38 μm and a wire diameter of 2.7 μm. The charge amount (μC/g) of the sample (toner) contained in each evaluation developer was calculated by the following formula: Total Amount of Electricity (μC) After Toner Drawing/Amount of Toner Drawn (g). The charge amount of the sample (toner) was evaluated according to the following criteria.

Good: Charge amount of at least 20 μC/g and no greater than 30 μC/g

Poor: Charge amount of less than 20 μC/g or greater than 30 μC/g (Charge Distribution)

First, 0.8 g of the sample (toner) and 10 g of the evaluation carrier prepared through the processes described above were put into a plastic container having 20 mL capacity. Subsequently, the plastic container was rotated at a rotation speed of 100 rpm by using a rotating mechanism for a predetermined time period (10 minutes). As a result, the evaluation developer (two-component developer) having stirred for 10 minutes was obtained. Subsequently, a charge distribution analyzer (Espart Analyzer, product of Hosokawa Micron Corporation) was used to measure the evaluation developer for the width (fC/μm) of the charge (Q/d) distribution at a ¼ height of the peak frequency (the frequency of the mode charge). The charge distribution of the sample (toner) was evaluated according to the following criteria.

Good: The charge distribution width at the specified frequency was less than 0.8 fC/μm.

Poor: The charge distribution width at the specified frequency was 0.8 fC/μm or more.

A narrow width of the charge distribution of the toner at the specified frequency means that the charge distribution of the toner was sharp, which is assumed to indicate that the amount of needle-like particles adhering to the surface of each toner core was substantially equal to one another. On the other hand, a wide width of the charge distribution at the specified frequency means that the charge distribution of the toner was broad, which is assumed to indicate that the amount of the needle-like particles adhering to the surface of each toner core varies from one particle to another.

(Low-Temperature Fixability and High-Temperature Fixability)

By using a mixer (Rocking Mixer (registered Japanese trademark), product of Aichi Electric Co., Ltd.), 10 parts by mass of the sample (toner) and 100 parts by mass of the evaluation toner prepared through the processes described above were mixed for 30 minutes. As a result, the evaluation developer (two-component developer) was obtained.

A color printer modified to enable fixing temperature adjustment (modified version of FS-05016, product of KYOCERA Document Solutions Inc.) was used as an evaluation apparatus. The two-component developer prepared through the processes described above was added into the development section in the evaluation apparatus modified as above, and the sample (toner) was added into the toner container in the evaluation apparatus.

Then, the evaluation apparatus was operated to form a 2 cm×3 cm solid image by using the evaluation paper with a weight of 90 g/m$^2$ (Color Copy 90, product of Mondi plc) and the toner mounting amount of 1.8 mg/cm$^2$. The images thus formed were used to evaluate the low-temperature fixability and high-temperature fixability of the sample (toner).

To evaluate the low-temperature fixability, the paper on which the image was formed in the manner described was passed through the fixing section in the evaluation apparatus at a linear velocity of 280 mm/s and the fixing temperature of 150° C. Subsequently, the paper having the image fixed thereon was folded in half with the image inside, and a 1 kg weight covered by cloth was rubbed back and forth five times on the fold. Subsequently, the paper was opened out, and the width along the fold where the toner was peeled off of the paper was measured. The low-temperature fixability of the sample (toner) was evaluated according to the following criteria.

Good: Toner peeling width of less than 1 mm.

Poor: Toner peeling width of 1 mm or more.

To evaluate the high-temperature fixability, the paper on which the image was formed as described above was passed through the fixing section in the evaluation apparatus at a linear velocity of 100 mm/s and the fixing temperature of 200° C. Subsequently, the paper having the image fixed thereon was visually checked for occurrence of high-temperature offset. The high-temperature fixability of the sample (toner) was evaluated according to the following criteria.

Good: No occurrence of high-temperature offset was observed.

Poor: Occurrence of high-temperature offset was observed.

[High-Temperature Preservability]

First, 10 g of the sample (toner) was put into a glass bottle, and the glass bottle containing the sample was left to stand for 100 hours in a constant temperature bath (CONVECTION OVEN, product of SANYO Electric Co., Ltd.) maintained at 50° C. Subsequently, the bottle was taken out from the constant temperature bath, and the toner was placed on a 26-mesh sieve having a known mass, and the mass of the sample (toner) before the sifting was measured. Subsequently, the sieve was attached to a powder tester (TYPE PT-E 84810, product of Hosokawa Micron Corporation). By following the instruction manual of the powder tester, the sieve was vibrated for 20 seconds at the vibration strength corresponding to a rheostat scale of 2.5. Then, the mass of toner remaining in the sieve was measured. The high-temperature preservability of the toner was evaluated according to the following criteria.

Good: The amount of residual toner in the sieve was 0.2 g or less.

Poor: The amount of residual toner in the sieve was more than 0.2 g.

[Shell Layer Homogeneity]

The homogeneity of the shell layers was evaluated through the immersion test as follows. First, the sample (toner) was dispersed in the solution of an anionic surfactant having the pH adjusted to 10. Thereafter, with the sample left immersed therein, the dispersion was maintained at 50° C. for 10 hours. The dispersion was then filtered and the sample (toner) obtained as a result of the filtering was dried.

Before and after the immersion test, the surface condition of the sample (toner) was observed with a scanning electron microscope (JSM-7500F, product of JEOL Ltd.). In addition, before and after the immersion test, the Brunauer-Emmett-Teller (BET) specific surface area of the sample (toner) was measured using a BET specific surface area analyzer (HM MODEL-1208, product of Mountech Co., Ltd.). The homogeneity of the shell layers of the sample (toner) was evaluated according to the following criteria relating to the change rate of BET specific surface area of the sample (toner) before and after the immersion test. The change rate of BET specific surface area is given by the following formula.

$$\text{Change Rate of BET Specific Surface Area} = S_2/S_1,$$

where $S_1$ denotes the BET specific surface area of the sample (toner) before the immersion test, and $S_2$ denotes the BET specific surface area of the sample (toner) after the immersion test.

The change rate of the BET specific surface area of 1.1 or less was evaluated as Good, and the change rate of the BET specific surface area of more than 1.1 was evaluated as Poor.

When shell layers of a toner are non-uniform in strength, a large number of through holes are assumed to be formed in the shell layers during the immersion test.

Table 2 gathers evaluation results of the samples (toners of Examples 1-8 and Comparative Examples of 1-7). Note that the evaluation result with respect to the number average major-axis diameter, the number average minor-axis diameter, the aspect ratio, and the volume resistivity value of the needle-like particles of the respective samples (toners of Examples 1-8 and Comparative Examples of 1-7) are shown in Table 1.

TABLE 2

| | Shell Layer Homogeneity [μm] | Low-Temperature Fixability [mm] | High-Temperature Fixability | High-Temperate Preservability [g] | Charge Distribution [fC/μm] | Charge Amount (1 Minute) [μC/g] | Charge Amount (60 Minutes) [μC/g] |
|---|---|---|---|---|---|---|---|
| Example 1 | 1.03 (Good) | 0.4 (Good) | Good | 0.10 (Good) | 0.70 (Good) | 26 (Good) | 24 (Good) |
| Example 2 | 1.03 (Good) | 0.4 (Good) | Good | 0.10 (Good) | 0.72 (Good) | 24 (Good) | 23 (Good) |
| Example 3 | 1.03 (Good) | 0.4 (Good) | Good | 0.10 (Good) | 0.68 (Good) | 28 (Good) | 26 (Good) |
| Example 4 | 1.06 (Good) | 0.6 (Good) | Good | 0.12 (Good) | 0.71 (Good) | 25 (Good) | 24 (Good) |
| Example 5 | 1.04 (Good) | 0.5 (Good) | Good | 0.12 (Good) | 0.72 (Good) | 27 (Good) | 25 (Good) |
| Example 6 | 1.04 (Good) | 0.6 (Good) | Good | 0.13 (Good) | 0.70 (Good) | 27 (Good) | 24 (Good) |
| Example 7 | 1.05 (Good) | 0.5 (Good) | Good | 0.13 (Good) | 0.73 (Good) | 25 (Good) | 24 (Good) |
| Example 8 | 1.04 (Good) | 0.6 (Good) | Good | 0.12 (Good) | 0.75 (Good) | 22 (Good) | 24 (Good) |
| Comparative Example 1 | 1.03 (Good) | 0.4 (Good) | Good | 0.10 (Good) | 0.94 (Poor) | 32 (Poor) | 38 (Poor) |
| Comparative Example 2 | 1.03 (Good) | 0.4 (Good) | Good | 0.10 (Good) | 0.63 (Good) | 19 (Poor) | 16 (Poor) |
| Comparative Example 3 | 1.18 (Poor) | 0.7 (Good) | Poor | 0.25 (Poor) | 1.09 (Poor) | 31 (Poor) | 36 (Poor) |
| Comparative Example 4 | 1.20 (Poor) | 0.8 (Good) | Poor | 0.32 (Poor) | 1.12 (Poor) | 35 (Poor) | 48 (Poor) |
| Comparative Example 5 | 1.17 (Poor) | 0.6 (Good) | Good | 0.27 (Poor) | 1.07 (Poor) | 37 (Poor) | 41 (Poor) |
| Comparative Example 6 | 1.16 (Poor) | 0.6 (Good) | Good | 0.25 (Poor) | 1.11 (Poor) | 34 (Poor) | 43 (Poor) |
| Comparative Example 7 | 1.24 (Poor) | 0.9 (Good) | Poor | 0.38 (Poor) | 1.15 (Poor) | 36 (Poor) | 42 (Poor) |

As Table 2 clarifies, the toners of Examples 1-8 were all excellent with respect to the charge amount, charge distribution, low-temperature fixability, high-temperature fixability, high-temperature preservability, and shell layer homogeneity. The toners of Examples 1-8 all had the needle-like particles with a volume resistivity value of at least $1.0\times10^{1}$ Ω·cm and no greater than $1.0\times10^{8}$ Ω·cm, a number average major-axis diameter of at least 0.2 μm and no greater than 2.0 μm, and a number average minor-axis diameter of at least 0.01 μm and no greater than 0.10 μm.

The toners of Comparative Examples 1 and 2 were each inferior with respect to the evaluations of the charge amount. This is assumed to be because the volume resistivity value of the needle-like particles was not within a range of $1.0\times10^{1}$ Ω·cm and $1.0\times10^{8}$ Ω·cm.

The toners of Comparative Examples 3 and 4 were each inferior with respect to the evaluations of the charge amount, charge distribution, high-temperature fixability, high-temperature preservability, and shell layer homogeneity. This is assumed to be because the number average major-axis diameter of the needle-like particles was not within a range of 0.2 μm and 2.0 μm.

The toners of Comparative Examples 5 and 6 were each inferior with respect to the evaluations of the charge amount, charge distribution, high-temperature preservability, and shell layer homogeneity. This is assumed to be because the number average minor-axis diameter of the needle-like particles was not within a range of 0.01 μm and 0.10 μm.

The toner of Comparative Example 7 was inferior with respect to the evaluations of the charge amount, charge distribution, high-temperature fixability, high-temperature preservability, and shell layer homogeneity. This is assumed to be because the spherical particles were used and thus the spherical particles failed to adhere firmly to the toner cores.

What is claimed is:

1. An electrostatic latent image developing toner comprising:

a plurality of toner particles each having a toner core, a shell layer, and needle-like particles, wherein the needle-like particles adhere to a surface of the toner core, the shell layer contains a thermosetting resin and covers the needle-like particles and the toner core, the needle-like particles contain titanium oxide, the needle-like particles have a volume resistivity value of at least $1.0\times10^{1}$ Ω·cm and no greater than $1.0\times10^{8}$ Ω·cm, the needle-like particles have a number average major-axis diameter of at least 0.2 μm and no greater than 2.0 μm, and the needle-like particles have a number average minor-axis diameter of at least 0.01 μm and no greater than 0.10 μm.

2. An electrostatic latent image developing toner according to claim 1, wherein each of the needle-like particles includes a titanium oxide particle and a conductive layer residing on the titanium oxide particle.

3. An electrostatic latent image developing toner according to claim 1, wherein each of the needle-like particles has a surface having been subjected to a hydrophilic surface treatment.

4. An electrostatic latent image developing toner according to claim 1, wherein each of the needle-like particles is longitudinally parallel to a surface of the toner core.

5. An electrostatic latent image developing toner according to claim 1, wherein the thermosetting resin is a melamine resin or a urea resin.

6. A manufacturing method for an electrostatic latent image developing toner, comprising:

preparing toner cores;

preparing needle-like particles;

causing the needle-like particles to adhere to a surface of the toner cores; and forming shell layers on a surface of the respective toner cores each having the needle-like particles adhering thereto, wherein the needle-like particles prepared contain titanium oxide, the needle-like particles prepared have a volume resistivity value of at least $1.0\times10^{1}$ Ω·cm and no greater than $1.0\times10^{8}$ Ω·cm, the needle-like particles prepared have a number average major-axis diameter of at least 0.2 μm and no greater than 2.0 μm, and the needle-like particles prepared have a number average minor-axis diameter of at least 0.01 μm and no greater than 0.10 μm.

7. A manufacturing method for an electrostatic latent image developing toner according to claim 6, wherein in the causing the needle-like particles to adhere, each of the needle-like particles is caused to adhere to one of the toner cores so as to be longitudinally parallel to a surface of the toner core.

* * * * *